US005481349A

United States Patent [19]

Satoh et al.

[11] Patent Number: 5,481,349

[45] Date of Patent: Jan. 2, 1996

[54] ELECTROPHOTOGRAPHIC IMAGE FIXING DEVICE AVOIDING OFFSET IN THE IMAGE BY MEANS OF DIFFERENTIAL ROLLER SPEED

[75] Inventors: Toshiya Satoh, Hitachi; Akiko Oikawa, Nakaminato; Katsuyoshi Onose; Keijiro Yagi, both of Hitachi; Tomoji Kitagishi, Ibaraki, all of Japan

[73] Assignee: Hitachi, Ltd., Tokyo, Japan

[21] Appl. No.: 164,799

[22] Filed: Dec. 10, 1993

[30] Foreign Application Priority Data

Dec. 11, 1992 [JP] Japan ..... 4-331597

[51] Int. Cl.[6] ..... G03G 15/20

[52] U.S. Cl. ..... 355/290; 219/216

[58] Field of Search ..... 355/282, 285, 355/290; 432/60; 219/216, 388, 469; 430/99; 118/60

[56] References Cited

U.S. PATENT DOCUMENTS 4,702,964 10/1987 Hirano et al. ..... 428/447

4,967,237 10/1990 Sasaki et al. ..... 355/290

FOREIGN PATENT DOCUMENTS 2-293867 12/1990 Japan .

*Primary Examiner*—Joan H. Pendegrass

*Attorney, Agent, or Firm*—Antonelli, Terry, Stout & Kraus

[57] ABSTRACT

An electrophotographic image fixing device having preventing offsetting and affording images of high quality is provided. The electrophotographic image fixing device has a heating roller 1, made up of a mandrel 5 and an elastic layer 4 of 40–60° in hardness, as measured by a spring type hardness meter of JIS K6301, provided on the mandrel, and a pressure roller 2, arranged in contact with the heating roller 1 and having a surface layer 6 the hardness of which is equal to or higher than the hardness of the elastic layer 4 of the heating roller 1. A heater 8 is provided for heating and fusion-depositing a toner image onto a toner substrate 3, by passing through the nip portion between the two rollers the toner substrate 3 on which the toner image has been formed. The linear speed of the surface of the pressure roller is 1.005–1.05 times that of the surface of the heating roller.

5 Claims, 3 Drawing Sheets

ELECTROPHOTOGRAPHIC IMAGE FIXING DEVICE AVOIDING OFFSET IN THE IMAGE BY MEANS OF DIFFERENTIAL ROLLER SPEED

BACKGROUND OF THE INVENTION

1. Field of the Invention

The present invention relates to an electrophotographic image fixing device and particularly, to a color electrophotographic image fixing device.

2. Description of Related Art

A step of fixing a toner image comprising toner particles on a toner substrate such as a paper or a plastic film is essential in electrophotographic processing. Various methods are employed for the fixing.

As one of them, a heat-fixing method, which comprises heating a toner image to fuse and fix it on a toner substrate, is usually and widely employed. For this purpose, it is necessary to heat the toner image up to the temperature at which the component which constitutes the toner becomes adhesive. Thus, in many cases, the toner is softened on the surface of a paper or a plastic film, which is the substrate, and when cooled, the toner is solidified and firmly stuck onto the substrate.

A specific means of heating and fusion-depositing the toner in an electrophotographic processing apparatus is passing a toner substrate having a toner image on its surface between a pair of rollers consisting of a heating roller and a pressure roller. At least one of the rollers is provided with an external or internal heating means and is heated to a temperature higher than the softening point of the toner.

A roller comprising a mandrel coated with an organosiloxane rubber or polytetrafluoroethylene is known for use as the heating roller. The organosiloxane rubber roller is generally coated with a silicone oil for releasing purpose. However, after repeated use, releasability from the surface of the organosiloxane rubber roller decreases, and offsetting of the toner or the substrate is apt to occur. Especially, when a color image, the toner of which is readily fused and is 2–3 times larger in the amount on the substrate than a monochromatic image, is continuously fixed by the roller, releasability from the organosiloxane rubber roller conspicuously decreases, and offset occurs several times sooner than when a monochromatic image is fixed.

On the other hand, the polytetrafluoro-ethylene-coated roller is generally superior in its releasing performance and endurance. However, since the thickness of the coat is small, the roller is poor in elasticity and spreads the toner by the fixing pressure to cause deterioration in resolution of the resulting image.

Since the toner substrate is pressed onto the heating roller by the pressure roller, the toner substrate which has passed through the fixing device is pulled by the heating roller, and offset is apt to occur. In order to inhibit this, a separating nail is provided in contact with the surface of the heating roller on the toner substrate-discharging side of the roller. However, the separating nail sometimes scratches the surface of the heating roller or leaves stripes on the images, causing considerable reduction in the quality of images.

For improving releasability between the heating roller and the toner substrate, a releasing oil such as silicone oil is applied to the heating roller. In this case, however, a means for applying the oil must be provided and and furthermore, the oil tends to stain the toner substrate.

Especially, when full-color images are to be formed, three primary color toners of yellow, magenta and cyan are superimposed, and various colors are reproduced by the subtractive color mixture. Therefore, in this case, thickness of the toners deposited on the toner substrate is 2–3 times that of the toners in the case of the conventional monochromatic image. Thus, inhibition of occurrence of the offset becomes more difficult.

For avoiding occurrence of the offset of color images, a method has been proposed which comprises transferring to a transfer paper a toner image formed by electrophotographic process using, as the color particles of yellow, magenta and cyan, toners of particular resin particles prepared by mixing a pigment with a dye treated with a resin different from the binder resin, passing the transfer paper between a heating roller and a pressure roller having a rubber-like elastic material on the mandrel in a hot roller fixing device, and discharging the transfer paper therefrom with shifting to the pressure roller side from the vertical direction of the line connecting the center of the heating roller and that of the pressure roller [Japanese Patent Kokai (Laid-Open) No. 2-293867].

SUMMARY OF THE INVENTION

The object of the present invention is to provide an electrophotographic fixing device superior in offsetting resistance.

The object above is achieved by the following:

(1) An electrophotographic image fixing device which has a heating roller comprising a mandrel and an elastic layer of 40°–60° in hardness (measured by a spring type hardness meter of JIS K6301) provided on the mandrel, a pressure roller arranged in contact with the heating roller and having a surface layer the hardness of which is equal to or higher than the hardness of the elastic layer of the heating roller, and a heating means for heating and fusion-depositing a toner image onto a toner substrate by passing through the nip portion between the two rollers the toner substrate on which the toner image has been formed, with the linear speed of the surface of the pressure roller being 1,005–1.05 time that of the surface of said heating roller.

(2) An electrophotographic image fixing device of the above type, wherein the angle (θ) formed by the discharging direction of the toner substrate and a tangent line of the surface of the heating roller at the outlet of the nip portion between the heating roller and the pressure roller is at least 4° preferable at least 6°.

(3) It is preferred to provide a discharging guide, or a discharging guide and discharging rollers, for the toner substrate so that the toner substrate can be discharged from the outlet of the nip portion in the direction of a given angle.

DETAILED DESCRIPTION OF PREFERRED EMBODIMENTS

Figure 1:
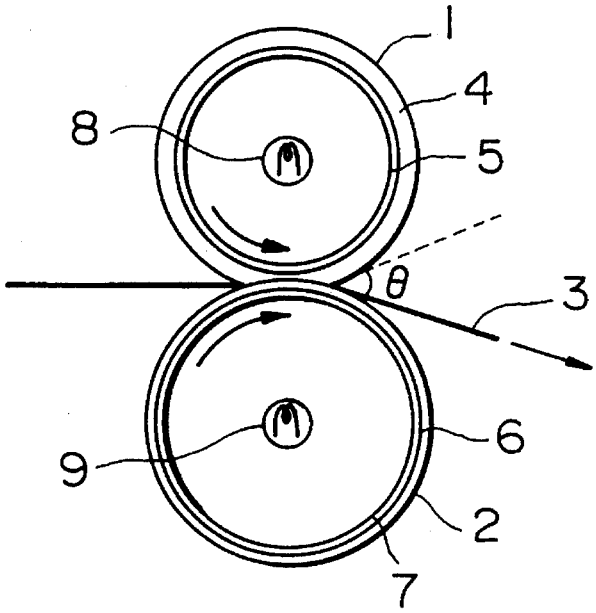
FIG. 1 is a schematical view of the fixing device used in Example 1.

An essential aspect of the present invention is that the linear speed of the surface of the pressure roller is 1.005–1.05 that of the surface of the heating roller. Thus, offsetting resistance of the toner substrate can be markedly improved.

Furthermore, it is preferred that the diameter of the heating roller be larger than that of the pressure roller, and it is desired that the angle (θ) formed by a tangent line of the surface of the heating roller at the outlet of the nip portion and the discharging direction of the toner substrate be at least 4°, preferably at least 6°. The upper limit of the angle is not limited, so long as the toner substrates after discharged do not curl so much or the construction of the fixing device is not affected. However, it is preferably 30° or less.

The heating roller can be heated by known heating means. For example, a hollow portion may be provided in the roller, and a sheathed heater and a temperature sensor provided therein to carry out temperature control. If necessary, similar heating means may also be provided on the pressure roller side.

As the elastic materials for the surface layer of the roller, there may be used heat resisting silicone rubbers such as HTV (high temperature vulcanization silicone rubber), RTV (room temperature vulcanization silicone rubber) and LTV (low temperature vulcanization silicone rubber), polytetrafluoroethylene, and the like. The hardness of them is preferably 40°–60° measured by a spring type hardness meter of JIS K6301. The thickness of the elastic layer is 0.3–5 mm, preferably 1–3 mm.

Preferably, the pressure roller is provided with an elastic layer having a hardness equal to or higher than that of the surface of the heating roller. The above-mentioned heat resisting silicone rubbers, polytetrafluoroethylene and the like are used as the elastic materials.

Furthermore, both the heating roller and the pressure roller may have a multi-layer laminate construction comprising two or more of silicone rubbers, polytetrafluoroethylene, fluororubbers and the like. However, it is also important that they have the given hardness mentioned above. Moreover, the pressure roller may be replaced by an endless belt, so long as it satisfies the conditions specified for the present invention.

For further improvement of releasability between the heating roller and the toner substrate, a coating means for releasing agents, such as silicone oil, may be provided on the heating roller.

The toner binders used in the present invention are unlimited as far as they are resins for toner used in general electrophotography. Examples of the binders are homopolymers of styrene and substitution products thereof such as polystyrene, poly-p-chloro-styrene and polyvinyltoluene, styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer and styrene-acrylonitrile-indene copolymer, polyvinyl chloride, polyvinyl acetate, polyethylene, polypropylene, silicone resin, polyester resin, polyurethane resin, polyamide resin, epoxy resin, polyvinyl butyral, rosin-modified resin, terpene resin, phenolic resin, xylene resin, aliphatic or alicyclic hydrocarbon resin, aromatic petroleum resin, chlorinated paraffin and paraffin wax. At least one of them is used.

As colorants for toners used in the present invention, there may be used known dyes and pigments such as carbon black, nigrosine dyes, benzidine yellow (such as Color Index: C.I. Pigment Yellow 12), nitro-phenylamine sulfonamide (such as C.I.: Disperse Yellow 33), monoazo dyes (such as C.I.: Solvent Yellow 16), quinacridone (such as C.I.: Pigment Red 122), anthraquinone dyes, diazo dyes (such as C.I.: Solvent Red 19), copper phthalocyanine (such as C.I.: Pigment Blue 15) and indanthrene blue.

The toners used in the present invention can also be used as two-component developers, comprising the toners and carriers, or one-component developers. Examples of the carriers for the two-component developers are magnetic powders such as iron powders and ferrite, glass beads, and these materials the surface of which is treated with resins.

When the electrophotographic image fixing device of the present invention is used, offset can be prevented, and especially, full-color images of excellent quality can be obtained. This is because the releasability between the toner substrate and the heating roller is improved when the angle (θ) formed by the discharging direction of the toner substrate and a tangent line which contacts with the surface of the heating roller at the outlet of the nip portion between the heating roller and the pressure roller is at least 4°, preferably at least 6°, and the linear speed of the surface of the pressure roller is 1.005–1.05 times that of the surface of the heating roller.

The present invention will be explained by the following examples.

Figure 5:
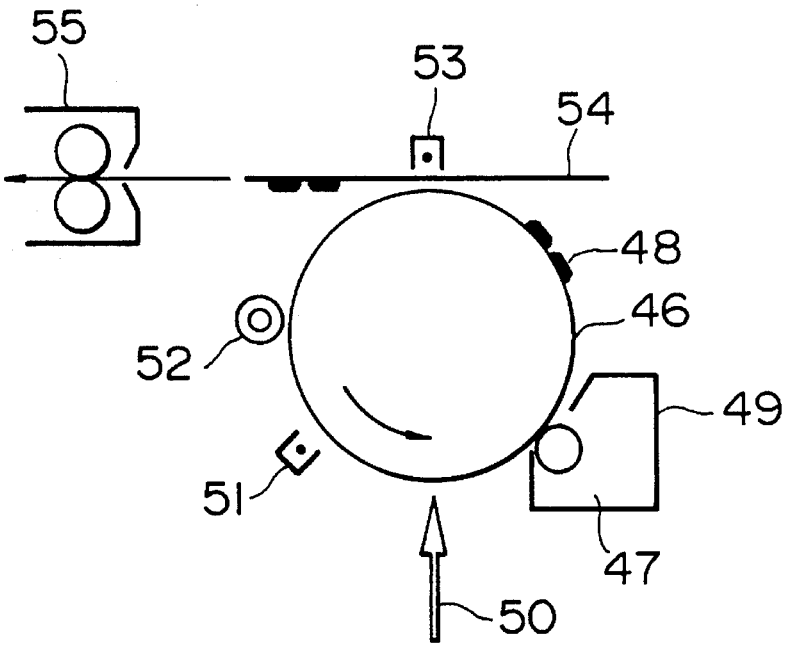
FIG. 5 is a schematical view of an electrophotographic apparatus.

FIG. 5 is a schematic view of an electrophotographic apparatus used for examination of the effect of the present invention. Photosensitive drum 46 having an organic photoconductor layer formed on the surface thereof, rotates in the direction of the arrow. A given charge is applied to the surface of the photosensitive drum 46 by charging device 51, and the charge of the portion irradiated with laser beam 50, controlled in accordance with image information, vanishes to form an electrostatic latent image on the surface of the photosensitive drum 46.

Then, the electrostatic latent image formed on the photosensitive drum 46 is developed with toner 48, triboelectrically charged in developer 47 contained in developing device 49, to form a visible image. This visible image is transferred to toner substrate 54 by transferring device 53, and the toner substrate 54 is passed through fixing device 55 to fix the toner image by heating. In FIG. 5, 52 is a cleaner.

Figure 6:
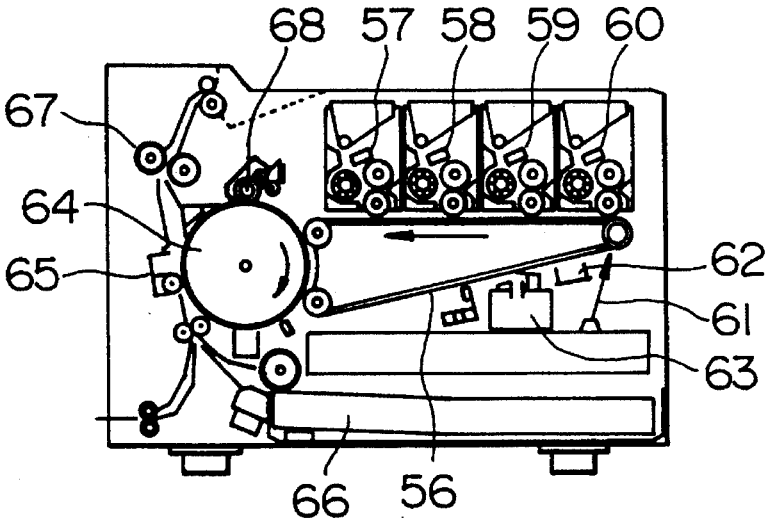
FIG. 6 is a schematical view of a full-color electrophotographic apparatus.

FIG. 6 is a schematic view of a full-color electrophotographic apparatus used for examination of the effect of the present invention. Photosensitive belt 56, having the organic photoconductor layer formed on its surface, rotates in the direction of the arrow. A given charge is applied to the surface of the photosensitive belt 56 by charging device 62, and the charge of the portion irradiated with laser beam 61, controlled in accordance with image information, vanishes to form an electrostatic latent image on the surface of the photosensitive belt 56. In FIG. 6, 57, 58, 59 and 60 are developing devices: yellow, magenta, cyan and black, respectively; 63 and 68 cleaners.

Then, the electrostatic latent image formed on the photosensitive belt 56 is first developed with a yellow toner triboelectrically charged in the developer contained in developing device (yellow) 57 to form a yellow visible image. This yellow visible image is transferred to intermediate transferring drum 64.

The above step is repeated with magenta, cyan and black to form full-color visible images of toners of the four colors on the intermediate transferring drum 64. The full-color visible images are transferred to toner substrate 66 by transferring device 65, and the toner substrate is passed through fixing device 67 to fix the toner images by heating.

The color toners used in the examples and the comparative examples are those which are prepared by blending the following colorants and charge regulators in the following amounts with 100 parts by weight of bisphenol-polyester resin (Mw=12,000, Mw/Mn=8.9, Tg=56° C., Tm=100° C.; Mw: weight-average molecular weight, Mn: number-average molecular weight, Tg: glass transition temperature, Tm=softening point).

| | |
|---|---|
| 1) Magenta toner | |
| C.I. Pigment Red 206 | 4.0 parts by weight |
| C.I. Solvent Red 109 | 1.5 parts by weight |
| 2) Cyan toner | |
| Phthalocyanine pigment | 5.0 parts by weight |
| 3) Yellow toner | |
| Pigment Yellow toner 6 | 5.0 parts by weight |
| 4) Black toner | |
| Carbon black | 5.0 parts by weight |

The above blend was heated and mixed by a roll mill, left for cooling, roughly ground by a cutting mill, furthermore finely ground by a supersonic jet mill and classified by a zigzag classifier to obtain a toner of 11 μm in average particle size. The resulting toner and a ferrite carrier (F-150 manufactured by Powder Teck Co., Ltd.) were mixed at a weight ratio of 3:97 to prepare a two-component developer.

EXAMPLE 1

One example of the construction of the fixing device is shown in FIG. 1. The heating roller 1 was prepared by coating one layer of silicone rubber 4 as an elastic layer. The layer had a thickness of 2.7 mm and a hardness of 50°, and the roller had an outer diameter of 25.5 mm. The pressure roller 2 was prepared by coating one layer of silicone rubber 6. The layer had a thickness of 1.0 mm and a hardness of 60°, and the roller had an outer diameter of 32.0 mm.

The heating device 9 was provided also at the pressure roller 2. The peel angle (θ) between the toner substrate 3 and the heating roller 1 at the outlet of the nip portion between the two rollers was about 8°. In FIG. 1, 5 and 7 are aluminum tubes, and 8 a heating device.

The above fixing device was fitted to an electrophotographic apparatus having a construction as shown in FIG. 5, and an image formation test was conducted using the above developers with settings of the linear speed of the pressure roller at 1.0, 1.005, 1.01, 1.03, 1.05 and 1.06 time that of the heating roller.

The results are as shown in Table 1. When the linear speed of the pressure roller was 1.005, 1.01, 1.03 and 1.05 times that of the heating roller, there was an area of fixing temperature where offset did not occur, and images of high quality were obtained. At the other linear speeds, there was no area of the fixing temperature where the offset did not occur.

TABLE 1

| Linear speed of pressing roller/Linear speed of heating roller | Area of fixing temperature where offset did not occur (°C.) |
|---|---|
| 1.00 | None |
| 1.005 | 120–150 |
| 1.01 | 120–180 |
| 1.03 | 120–180 |
| 1.05 | 120–150 |
| 1.06 | None |

EXAMPLE 2

Figure 2:
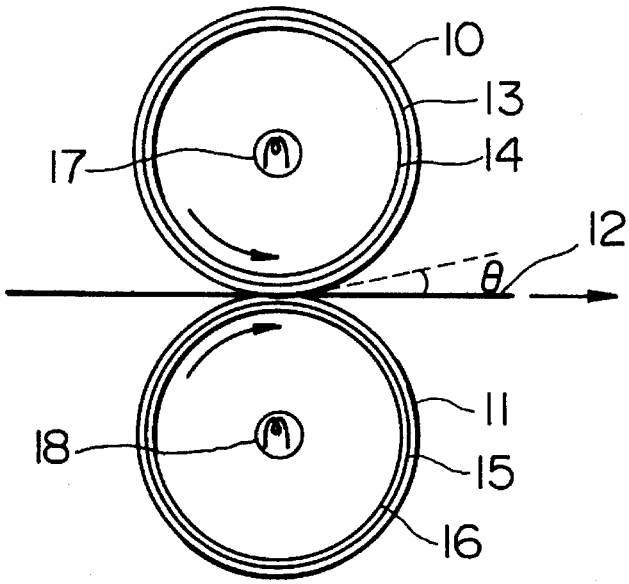
FIG. 2 is a schematical view of the fixing device used in Example 2.

A second example of the construction of the fixing device is shown in FIG. 2. The heating roller 10 was prepared by coating one layer of silicone rubber 13. The layer had a thickness of 1.5 mm and a hardness of 50°, and the roller had an outer diameter of 30.0 mm. The pressure roller 11 was prepared by coating one layer of silicone rubber. The layer had a thickness of 1.5 mm and a hardness of 50° and the roller had a diameter of 30.0 mm. The heating device 18 was provided also at the pressure roller 11. The peel angle (θ) between the toner substrate and the heating roller was about 4°. In FIG. 2, 11 is a pressure roller, 12 a toner substrate, 14 and 16 aluminum tubes, 15 a layer made of silicone rubber, and 17 a heating device.

The above fixing device was fitted to an electrophotographic apparatus having a construction as shown in FIG. 5, and formation tests were conducted in the same manner as in Example 1 using the above developers, while setting the linear speed of the pressure roller at 1.0, 1.005, 1.01, 1.03, 1.05 and 1.06 times that of the heating roller.

The results are as shown in Table 2. When the linear speed of the pressure roller was 1.005, 1.01, 1.03 and 1.05 times that of the heating roller, there was an area of fixing temperature where offset did not occur, and images of high quality were obtained. At the other linear speeds, there was no area of the fixing temperature where the offset did not occur.

TABLE 2

| Linear speed of pressure roller/Linear speed of heating roller | Area of fixing temperature where offset did not occur (°C.) |
|---|---|
| 1.00 | None |
| 1.005 | 120–130 |
| 1.01 | 120–150 |
| 1.03 | 120–150 |
| 1.05 | 120–130 |
| 1.06 | None |

COMPARATIVE EXAMPLE 1

Figure 3:
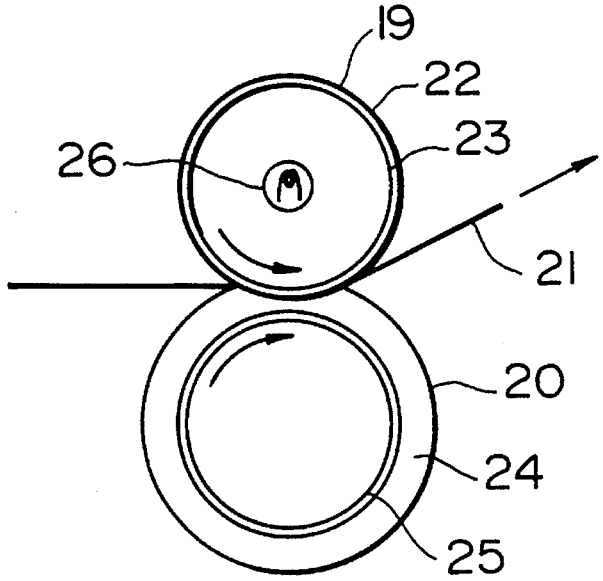
FIG. 3 is a schematical view of the fixing device used in Comparative Example 1.

The construction used in this comparative example is shown in FIG. 3. The heating roller 19 was prepared by coating Teflon on the surface of an aluminum tube. The Teflon layer had a thickness of 0.03 mm and a hardness of 80° and the roller had an outer diameter of 32.0 mm. The pressure roller 20 was prepared by coating one layer of silicone rubber. The layer had a thickness of 3.0 mm and a hardness of 40°, and the roller had a diameter of 40.0 mm. The heating device 26 was provided only at the heating roller 19. The peel angle between the toner substrate 21 and the heating roller 19 was about 0°. In FIG. 3, 22 is a Teflon coat, 23 and 25 aluminum tubes, and 24 a layer made of silicone rubber.

The above fixing device was fitted to an electrophotographic apparatus having a construction as shown in FIG. 5, and image formation test were conducted in the same manner as in Example 1 using the above developers with settings of the linear speed of the pressure roller at 1.0, 1.005, 1.01, 1.03, 1.05 and 1.06 time that of the heating roller.

As a result, at any linear speed of the pressure roller there was no area of fixing temperature where offset did not occur, and a test on printing endurance was not be able to be conducted.

COMPARATIVE EXAMPLE 2

Figure 4:
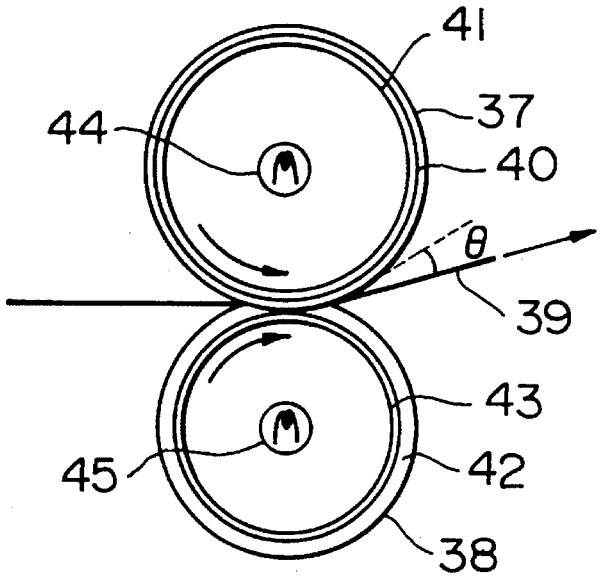
FIG. 4 is a schematical view of the fixing device used in Comparative Example 2.

The construction used in this comparative example is shown in FIG. 4. The heating roller 37 was prepared by coating one layer of silicone rubber. The layer had a thickness of 1.0 mm and a hardness of 40° and the roller had a diameter of 32.0 mm. The pressure roller 38 was prepared by coating one layer of silicone rubber. The layer had a thickness of 2.7 mm and a hardness of 20° and the roller had a diameter of 25.5 mm. The heating device 45 was provided also at the pressure roller 38. The peel angle (θ) between the toner substrate and the heating roller was about 2°. In FIG. 4, 39 is a toner substrate, 40 and 42 are layers made of silicone rubber, 41 and 43 are aluminum tubes, and 44 is a heating device.

The above fixing device was fitted to an electrophotographic apparatus having a construction as shown in FIG. 5, and image formation test were conducted in the same manner as in Example 1 using the above developers with settings of the linear speed of the pressure roller at 1.0, 1.005, 1.01, 1.03, 1.05 and 1.06 time that of the heating roller.

As a result, at any linear speeds of the pressure roller there was no area of fixing temperature where offset did not occur, and a test on printing endurance was not be able to be conducted.

EXAMPLE 3

The fixing device used in Example 1 was fitted to the full-color electrophotographic apparatus having the construction as shown in FIG. 6, and image formation tests were conducted in the same manner as in Example 1 with settings of the linear speed of the pressure roller at 1.0, 1.005, 1.01, 1.03, 1.05 and 1.06 times that of the heating roller and using the developers 1), 2), 3) and 4) above.

The results are as shown in Table 3. When the linear speed of the pressure roller was 1.005, 1.01, 1.03 and 1.05 times that of the heating roller, there was an area of fixing temperature where offset did not occur, and images of high quality were obtained. At the other linear speeds, there was no area of the fixing temperature where the offset did not occur.

TABLE 3

| Linear speed of pressure roller/Linear speed of heating roller | Area of fixing temperature where offset did not occur (°C.) |
|---|---|
| 1.00 | None |

TABLE 3-continued

| Linear speed of pressure roller/Linear speed of heating roller | Area of fixing temperature where offset did not occur (°C.) |
|---|---|
| 1.005 | 120–140 |
| 1.01 | 120–160 |
| 1.03 | 120–160 |
| 1.05 | 120–140 |
| 1.06 | None |

In the above examples and comparative examples, the surface of the heating roller was not coated with silicone oil or the like which is used for prevention of occurrence of offset, but it is needless to say that the similar effects can be obtained also when the roller is coated with silicone oil or the like.

As explained above, when full-color images are formed on a toner substrate such as a paper or a plastic film by an electrophotographic process using developers comprising the three color toners of yellow, magenta and cyan, and optionally additional black toner, and the images are fixed by heating between a heating roller and a pressure roller, occurrence of offset can be inhibited by setting the hardness of the surface of the rollers and the linear speed of the rollers as specified in the present invention and by setting at at least 4°, preferably at least 6°, the angle formed by the discharging direction of the toner substrate and a tangent line of the surface of the heating roller at the outlet of the nip portion. As a result, full-color images of high quality can be obtained.

What is claimed is:

1. An electrophotographic image fixing device comprising:

a heating roller, including a mandrel, and an elastic layer of 40°–60° in hardness, measured by a spring type hardness meter of JIS K6301 type, provided on the mandrel;

a pressure roller arranged in contact with the heating roller and having a surface layer with a hardness equal to or higher than the hardness of the elastic layer of the heating roller; and heating means for heating and fusion-depositing a toner image onto a toner substrate passing through the nip portion between the heating roller and the pressure roller and having the toner image formed thereon; first drive means for rotating the heating roller such that the surface of the heating roller moves at a first linear speed; and second drive means for rotating the pressure roller such that the surface of the pressure roller moves at a second linear speed 1.005–1.05 times the first linear speed.

2. An electrophotographic image fixing device according to claim 1, wherein the nip portion between the heating roller and the pressure roller discharges the toner substrate such that an angle (θ), formed by the discharging direction of the toner substrate and a tangent line of the surface of the heating roller at the outlet of the nip portion between the heating roller and the pressure roller, is at least 4°.

3. An electrophotographic image fixing device according to claim 2, wherein the angle (θ) is at least 6°.

4. An electrophotographic image fixing device according to any one of claims 1–3, wherein the pressure roller is an endless belt.

5. An electrophotographic image fixing device according to any one of claims 1–3, wherein the toner image is a full-color image.

* * * * *